United States Patent [19]

Unger

[11] Patent Number: 4,516,305

[45] Date of Patent: May 14, 1985

[54] WEBBING TENSIONING METHOD

[75] Inventor: Goetz W. Unger, East Greenville, Pa.

[73] Assignee: Knoll International, Inc., New York, N.Y.

[21] Appl. No.: 529,341

[22] Filed: Sep. 6, 1983

Related U.S. Application Data

[62] Division of Ser. No. 330,948, Dec. 15, 1981, Pat. No. 4,431,229 issued Feb. 14, 1984.

[51] Int. Cl.[3] ..... B23P 11/02

[52] U.S. Cl. ..... 29/448; 29/91.1; 29/91.5

[58] Field of Search ..... 29/91.5, 91.1, 446, 29/448, 449; 297/454, 452, 441, 444, 443, 449, 297/440; 160/328, 378; 72/342, 347, 46

[56] References Cited

U.S. PATENT DOCUMENTS

| | | | |
|---|---|---|---|
| 488,095 | 12/1982 | Scott et al. | 297/441 |
| 636,671 | 11/1899 | Kidd et al. | 297/440 X |
| 1,060,664 | 5/1913 | Beaudry | 160/378 |
| 1,400,717 | 12/1921 | Benson et al. | 160/378 X |
| 1,422,915 | 7/1922 | Benson et al. | 160/378 X |
| 1,918,073 | 7/1933 | Williams et al. | 160/328 |
| 2,600,192 | 6/1952 | Bell | 160/378 X |
| 3,041,109 | 6/1962 | Eames et al. | 297/449 |
| 3,273,327 | 9/1966 | Hoffman | 160/378 X |
| 3,437,375 | 4/1969 | Kettler | 297/441 |
| 3,805,367 | 4/1974 | Hasty | 29/448 |
| 3,837,019 | 9/1974 | Hoff | 297/441 X |
| 3,863,698 | 2/1975 | Uchida | 297/441 X |
| 4,008,746 | 2/1977 | Romberg | 160/328 |
| 4,146,269 | 3/1979 | Beckley | 297/441 X |

FOREIGN PATENT DOCUMENTS

| | | | |
|---|---|---|---|
| 1235449 | 5/1960 | France | 160/378 |

*Primary Examiner*—Charlie T. Moon
*Attorney, Agent, or Firm*—Robert Scobey

[57] ABSTRACT

An assembly for stretching and securing upholstery fabric or the like in place utilizes a pair of bars contained by pockets along opposite edges of the fabric. The bars are articulatedly secured at corresponding ends thereof to a framework, and are forced apart at their opposite ends by a bendable rod which engages the free bar ends and urges them apart when the rod is straightened. The bendable rod and engaged bar ends, along with an additional upholstery bar, together sandwich fabric therebetween and secure the fabric in place. The sandwich assembly is concealed by a flap of upholstery material.

2 Claims, 8 Drawing Figures

FIG. 5.
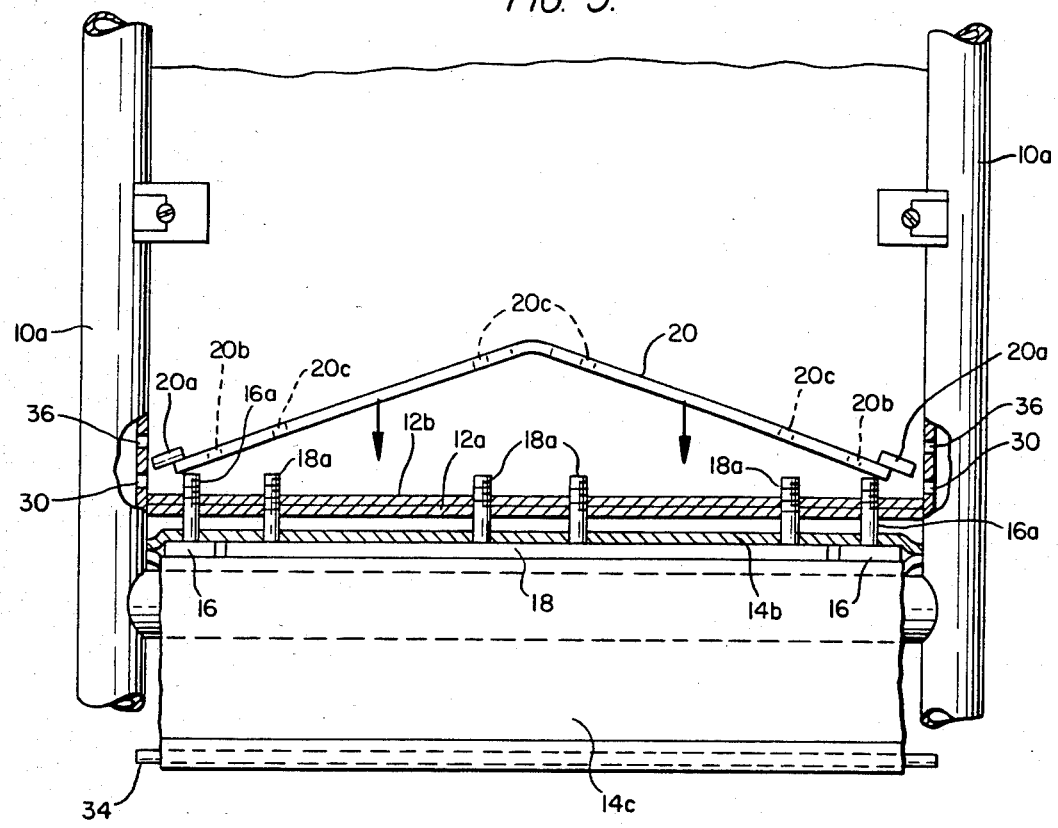
FIG. 6.
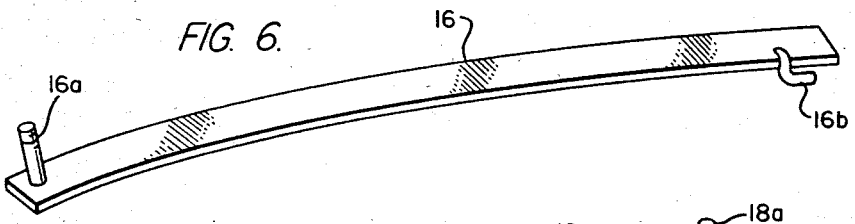
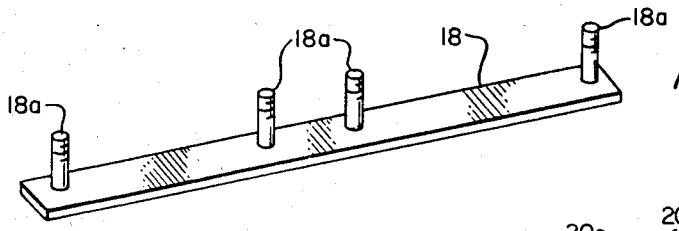
FIG. 7.
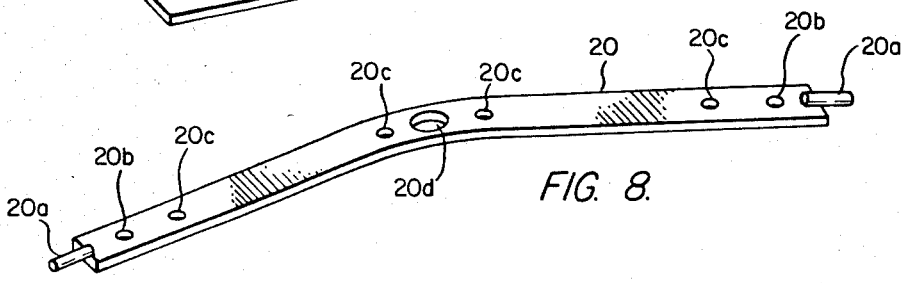
FIG. 8.

WEBBING TENSIONING METHOD

CROSS REFERENCE TO RELATED APPLICATION

This application is a division of prior U.S. application Ser. No. 330,948, filed Dec. 15, 1981, now U.S. Pat. No. 4,431,229, issued Feb. 14, 1984.

BACKGROUND AND BRIEF DESCRIPTION OF THE INVENTION

This invention relates to the stretching and securing of upholstery fabric or the like in place, and finds particular application to the upholstering of a chair.

It is known to stretch fabrics in upholstery operations. Such stretching operations are generally not easily carried out, and it is thus an object of the present invention to provide an upholstering operations which achieves fabric stretching simply, quickly, and with a relatively few parts involved.

Upholstering funriture oftentimes requires special tools, and it is another object of the present invention to obviate the use of such tools.

The present invention finds particular application in the upholstering of a tubular chair. Briefly, the back upholstery for the chair is stretched and secured in place utilizing a pair of bars contained by pockets along opposite edges of the fabric. The bars are articulated secured at corresponding ends thereof to the tubular framework, at the top of the back of the chair. At the lower ends of these bars, in the region of the joinder of the chair seat and back, the bars are forced apart through use of a bendable rod which engages the free ends of the bars. As the rod, initially in a bent condition, is straightened, the free ends of the bars are forced apart, thereby stretching the back upholstery fabric. These free bar ends are then secured to the bendable rod, which in turn is secured to the framework of the chair, together with an additional upholstery bar, all of which create a sandwich with fabric held between the bars and rod. This sandwich is concealed by use of a fabric flap that covers the sandwich.

The prior art utilizes bendable members, generally to produce knockdown or folding chairs. Further, fabric stretching in chairs is known, as is the stretching of screening. The prior art does not disclose nor suggest, however, the techniques utilized in the present invention.

Representative patents illustrative of the state of art as described generally above, are as follows:

| U.S. Pat. No. | Inventor | Issue Date |
|---|---|---|
| 488,095 | Scott & Schaaf | 12/13/92 |
| 636,671 | Kidd & Depue | 11/7/99 |
| 1,043,444 | Lindbeck | 11/5/12 |
| 1,060,664 | Beaudry | 5/6/13 |
| 1,325,961 | Smith | 12/23/19 |
| 1,400,717 | Benson & Bruce | 12/20/21 |
| 1,445,534 | Miller | 2/13/23 |
| 1,902,335 | Moss | 3/21/33 |
| 3,041,109 | Eames et al | 6/26/62 |
| 3,437,375 | Kettler | 4/8/69 |

The invention will be more completely understood by reference to the following detailed description.

BRIEF DESCRIPTION OF THE DRAWING

FIG. 5 is a bottom view of a part of the chair of FIG. 1.

FIG. 6 is a perspective view of one of the upholstery bars used in the chair of FIG. 1.

FIG. 7 is a perspective view of another upholstery bar used in the chair of FIG. 1.

FIG. 8 is a perspective view of a bendable rod used in the chair of FIG. 1.

DETAILED DESCRIPTION

Figure 1:
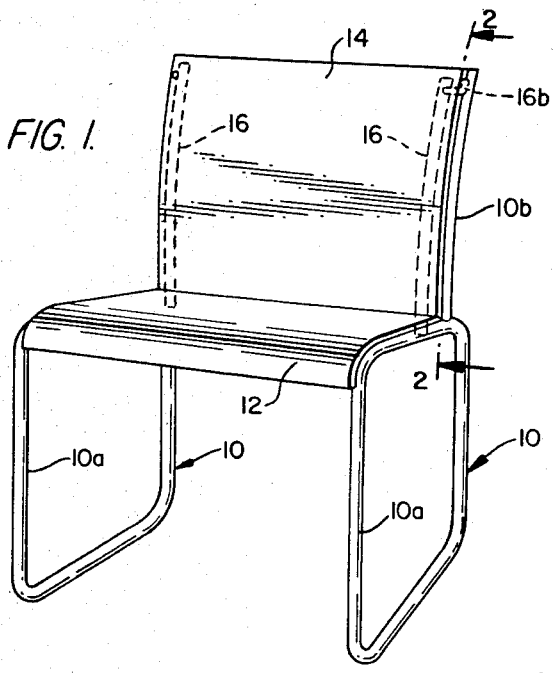
FIG. 1 is a front perspective view of a tubular chair embodying the present invention.

Referring to FIG. 1, a tubular chair is shown having a pair of side members 10. Each of the side members is composed of a closed-loop portion 10*a* constituting a leg and feet support structure, and an upwardly extending tubular extension 10*b* constituting a back support structure. The chair is upholstered with a separate seat 12 and back support 14. The seat support 12 is advantageously of the type disclosed in co-pending application Ser. No. 311,637 filed Oct. 15, 1981, now abandoned in favor of file wrapper continuation Ser. No. 503,075 filed June 13,1983, now U.S. Pat. No. 4,435,882 by the present inventor and assigned to the assignee of the present application and entitled ASSEMBLY FOR HOLDING AND TENSIONING A WEBBING. The disclosure of that co-pending application is hereby incorporated herein by reference.

The present invention finds particular application in the method of completing the back upholstery 14 in the chair. Besides the upholstery fabric, three parts are essentially involved, shown in FIGS. 6 to 8. These parts are an upholstery bar 16, shown in FIG. 6 as being slightly curved to conform to the curvature of the tubular back extension 10*b*. The upholstery bar 16 includes a stud 16*a* at one end thereof and a hook 16*b* at the other end thereof. An additional upholstery bar 18 is utilized, as shown in FIG. 7. This upholstery bar includes four studs 18*a* extending therefrom. Finally, as shown in FIG. 8, a bendable rod 20 is employed having dowels 20*a* at the ends thereof.

Figure 4:
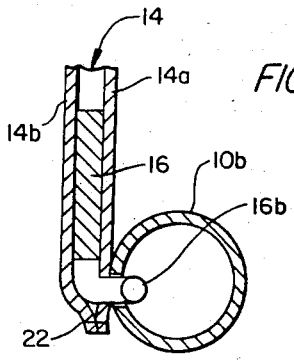
FIG. 4 is a sectional view, to an enlarged scale, taken along the section 4—4 in FIG. 2.

The back support fabric 14 is typically formed with pockets along the vertical edges thereof in which the upholstery bars 16 are positioned. FIG. 4 shows one of the bars 16 positioned within the pocket formed by the joining together of upholstery pieces 14*a* and 14*b*, sewn together along the vertical edges thereof, as at 22. In a typical upholstered chair, the upholstered back support may thus comprise a forwardly directed fabric piece 14*b* and a rearwardly directed fabric piece 14*a*, with padding material therebetween.

Figure 2:
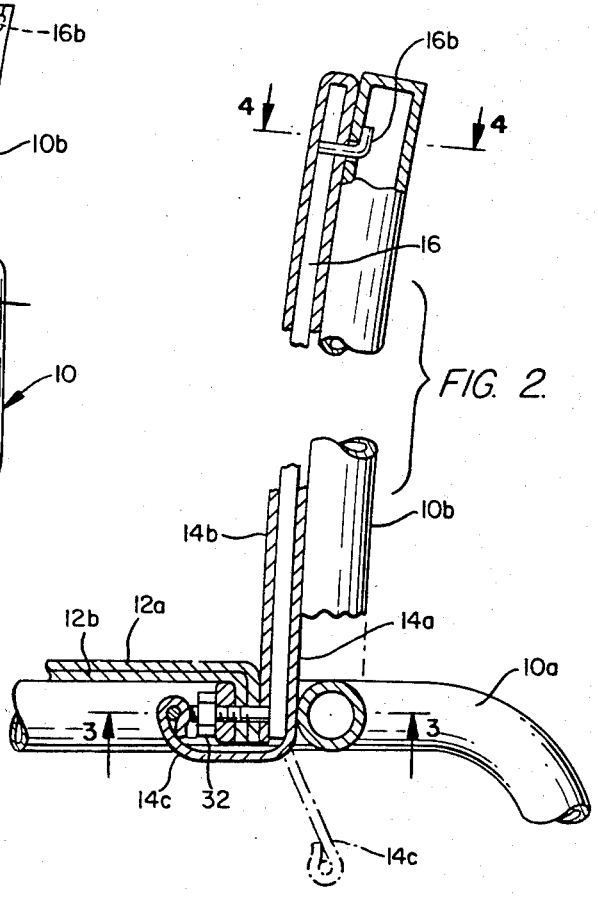
FIG. 2 is a sectional view, to an enlarged scale, taken along the section of 2—2 in FIG. 1.

The upholstery bars 16, thus positioned within the pockets along the edges of the back rest upholstery fabric 14 are situated adjacent to the upwardly extending tubular pieces 10*b*. The hooks 16*b* at the upper ends of the upholstery rods extend outwardly through holes in the fabric and through holes in the tubular pieces 10*b* so that they are positioned inside those tubular pieces, as shown in FIGS. 2 and 4. Thus the upholstery bars 16 are articulatedly secured at their upper ends to the upper ends of the tubular chair pieces 10*b*.

Figure 3:
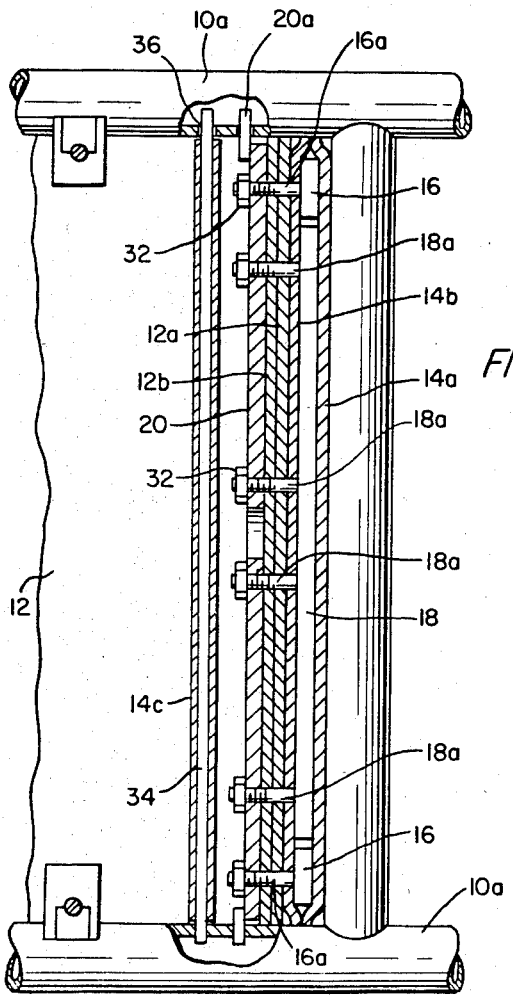
FIG. 3 is a sectional view, taken along the section 3—3 in FIG. 2.

The lower, free ends of the upholstery bars 16, carrying the studs 16*a*, are forced apart to stretch the back support upholstery fabric 14 as will now be explained. Referring to FIGS. 3 and 5, both of which are views of the bottom of the chair, it will be seen that the studs 16*a* extend first through the forwardly directed fabric piece 14*b* (and whatever upholstery padding may be present) and thence through fabric pieces 12*a* and 12*b* (these latter fabric pieces together form the upholstery of the seat 12). Positioned between the free ends of the upholstery bar 16 is the additional upholstery bar 18, with its studs 18*a* extending through these same fabric pieces 14*b*, 12*a*, and 12*b*. As shown in FIG. 5, the bendable rod 20, in its V-shaped or bent position, is maneuvered so that holes 20*b* therein (see also FIG. 8) are positioned about the studs 16*a*. As the rod 20 is straightened, the sides of the holes 20*b* engage the upholstery bar studs 16*a* and force those studs apart, thereby stretching the back support fabric 14. Ultimately, in its straightened position, the dowels 20*a* at the end of the rod 20 are positioned within corresponding holes 30 in the tubular side frames 10*a*. Also, the studs 18*a* extend through holes 20*c* in the rod 20, and the entire sandwich of stud-carrying ends of upholstery bars 16, upholstery rod 18, upholstery materials 14*b*, 12*a*, and 12*b*, and bendable rod 20 are maintained securely in position by nuts 32 which are screwed onto the ends of the studs.

The rearwardly directed fabric piece 14*a*, at its lowermost portion, constitutes a flap 14*c* which conceals the sandwich just referred to. Typically, a rod 34 is contained within a pocket at the end (lower) of the rearwardly directed fabric piece 14*a*. That fabric piece, which normally hangs free as shown in FIGS. 2 and 5, is wrapped about the "sandwich", with the ends of the rod 34 being positioned within corresponding holes 36 in the tubular side pieces 10*a*.

It will be noted that the upholstering of the back support is easily accomplished, without the use of any special tools. The bendable rod 20, which includes hole 20*d* therein (FIG. 8) to facilitate its bending, may be bent a number of times before fatigue sets in and the rod breaks. Thus, the chair may be easily upholstered as well as reupholstered, and no special tools are required. The straightening of the bent rod stretches or tensions the back support fabric, and the bolted-together sandwich ensures the permanence of the finished upholstery.

It will be realized that the above-described preferred embodiment of the invention is susceptible of modification. The use of studs and nuts may be replaced by other connections. The sandwich-concealing flap 14*c* could be held in place by other means than a rod such as the rod 34. These are just a few examples of changes that might be made. Accordingly, the embodiment described above should be taken as representative and in no way limiting of the invention.

The invention is defined by the following claims.

What is claimed is:

1. A method of stretching and securing upholstery fabric in place in a rigid framework of a chair or the like comprising positioning a pair of bars in pockets along opposite edges of the fabric, articulatedly securing the bars at corresponding ends thereof to spaced portions of said rigid framework, forcing apart the other ends of the bars by straightening a bent rigid elongated support between said other ends to stretch the fabric, and securing said other ends of said bars and said straightened rigid elongated support in said forced-apart condition to said spaced portions of said fixed framework to maintain said fabric in stretched condition.

2. A method as in claim 1, including concealing said rigid support by extending fabric thereabout.

* * * * *